US005944625A

United States Patent [19]

Janes

[11] Patent Number: 5,944,625

[45] **Date of Patent: *Aug. 31, 1999**

[54] CUSHION BUMPER ASSEMBLY FOR SPORTS RACQUETS

[75] Inventor: Richard Janes, Burlington Township, N.J.

[73] Assignee: Prince Sports Group, Inc., Bordentown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/751,415

[22] Filed: Nov. 18, 1996

Related U.S. Application Data

[63] Continuation of application No. 08/438,509, May 10, 1995, abandoned.

[51] Int. Cl.[6] ..... A63B 49/14

[52] U.S. Cl. ..... 473/548; 473/539

[58] Field of Search ..... 473/539, 548

[56] References Cited

U.S. PATENT DOCUMENTS

| | | | |
|---|---|---|---|
| 4,776,592 | 10/1988 | Umlauft et al. | 273/73 D |
| 4,913,434 | 4/1990 | Fischer | 273/73 D X |
| 5,029,859 | 7/1991 | Davis | 273/73 C X |
| 5,102,132 | 4/1992 | Chen | 273/73 D X |
| 5,165,687 | 11/1992 | Soong | 273/73 C |
| 5,178,386 | 1/1993 | Tzeng | 273/73 D X |
| 5,280,907 | 1/1994 | Liu | 273/73 C |
| 5,362,071 | 11/1994 | Liu . | |

FOREIGN PATENT DOCUMENTS

| | | |
|---|---|---|
| 210514 | 8/1993 | Taiwan . |

*Primary Examiner*—Raleigh W. Chiu
*Attorney, Agent, or Firm*—White & Case L.L.P.

[57] ABSTRACT

A bumper strip assembly for sports racquets comprises a bumper strip portion, which may be a conventional bumper strip, and preferably a pair of polymeric felt or urethane foam strips. The cushion strips preferably have a density in the range of 0.35–0.60 g/cc and a hardness in the range of 50–60 Shore A durometer, and are disposed between the bumper strip flanges and the outer surface of the racquet frame. The cushioning strips are very lightweight, having a combined weight on the order of 3 grams, yet are extremely effective in protecting the frame from damage due to impact with a hard court surface.

15 Claims, 6 Drawing Sheets

CUSHION BUMPER ASSEMBLY FOR SPORTS RACQUETS

This application is a continuation of application Ser. No. 438,509, filed on May 10, 1995 now abandoned.

FIELD OF INVENTION

The present invention relates to sports racquets such as racquetball, squash, and tennis racquets.

BACKGROUND OF THE INVENTION

High end sports racquets are typically made with frames of composite material, such as carbon fiber-reinforced epoxy, which is commonly referred to as "graphite". Such materials have a high stiffness-to-weight ratio, and therefore allow frames to be made very lightweight, for easy maneuverability, and at the same time stiff for good power.

Sports racquets made of composite materials are normally provided with a plastic grommet strip on either side of the frame, and a plastic bumper strip that extends around the outer portion of the racquet head. The strips contain hollow grommet pegs that extend through string holes drilled in the frame. After crossing the stringing area, each string exits the stringing area through one grommet peg and extends along the grommet or bumper strip surface to the next grommet peg, where it re-enters the stringing area. The purpose of the grommet and bumper strips is to protect the strings and composite material from damaging one another, particularly at the tops of the string holes where the strings bend sharply.

In addition to being susceptible to damage from the strings, composite materials can be damaged upon impact with a hard surface. In squash or racquetball, the racquet frame can be damaged upon striking the floor or a wall. In tennis, the frame can be damaged by hitting court surface, which can occur when hitting a low shot.

The games of squash and racquetball require quick reflexes and fast racquet movements. It is therefore desirable to make the racquets lightweight. Also, although lighter weight is not as important in tennis, there currently is a preference among some tennis players for lighter weight racquets. One of the ways of reducing racquet weight is to reduce the wall thickness of the frame. However, susceptibility to damage from impact with the court surface increases as the wall sections are made thinner.

Normally, the outside surface of the racquet head is provided with a stringing groove. The two grommet strips fit into the stringing groove on either side of the racquet. The bumper strip connects the ends of the two grommet strips. The bumper strip has a center strip portion which, like the grommet strips, contains grommet pegs and is disposed in the stringing groove. The bumper strip also has two flanges that extend laterally from the center strip portion so as to cover the racquet frame outer surface in order to protect the head from impact damage. Because damage that is the result of impact with a court surface is most likely to occur in the outer region of the head, and in order to avoid adding unnecessary weight, the bumper strip is normally confined to the outer head region only.

Due to the high stringing tensions typically used in sports racquets, the grommet and bumper strips need to be made of a relatively hard material in order to protect the frame from being damaged by the strings. Thus the grommet and bumper strips are typically made of a nylon having a hardness in the range of Shore D 80 durometer.

U.S. Pat. No. 5,165,687 discloses gluing a pair of strips of viscoelastic damping material to the outer frame surface in order to dampen high frequency vibrations of the frame. In one embodiment, the strips are very thin, i.e., about 1.0 mm, and are positioned between the frame and the flanges of a conventional bumper strip. In an alternative embodiment, the flanges of the bumper strip are removed, in order to utilize a "thick dampening layer" of about 3.0 mm. The patent notes that the "thick damping layer" will provide an additional effect of absorbing ground impact shock better than a plastic bumper guard.

According to the '687 patent, either embodiment will add about 10 grams of additional weight to the outer region of the racquet. In the case of the thin strip embodiment, the density of the viscoelastic materials used in the '687 patent will result in a total weight, using 1 mm thick strips, of 10 gram. The thick dampening layer will of course weigh more, but the additional weight increase is partially offset by the weight savings resulting from removing the two flanges of the bumper strip.

Adding 10 grams of weight to the outer region of the racquet frame is very undesirable, because it makes the racquet less maneuverable. Moreover, while it would be desirable to improve the racquet's ability to absorb ground impact shock, the proposal of the '687 patent to remove the flanges of the bumper strip and glue a thick dampening layer to the frame appears to have certain drawbacks. In particular, when the frame scrapes a court surface, large shear stresses and heat can result, which would tend to tear the glued layer off the frame, as well as damage the relatively soft viscoelastic material. It would thus be desirable to continue to use a hard nylon bumper strip.

SUMMARY OF THE INVENTION

A bumper strip assembly for sports racquets comprises a bumper strip portion, which may be a conventional bumper strip, and at least one strip of lightweight polymeric felt or cellular foam such as urethane foam. Most preferably, the at least one cushioning strip is a pair of felt strips, made of polymeric fibrous material, disposed between the bumper strip flanges and the outer surface of the racquet frame.

The cushion strip material, whether felt or cellular foam, has a density of 0.8 g/cc (grams per cubic centimeter) or less, and preferably in the range of 0.35–0.60 g/cc. Most preferably, the cushion strip material has a density of about 0.45 g/cc. The material preferably has a hardness of 60 Shore A durometer or less, preferably in the range of 50–60 Shore A durometer, and most preferably Shore A 55.

Although the cushioning strips are very lightweight, weighing on the order of 3 grams total, they have proven to be extremely effective, when used in combination with the hard nylon flanges of the bumper strip, in protecting the frame from damage due to impact with a hard court surface.

In one embodiment, the underside of each flange includes a groove for receiving a respective cushioning strip. In other embodiments, the cushion strips may be adhered to the bumper strip flanges or to the racquet frame outer surface.

In another embodiment, the grommet pegs are separate from the bumper strip portion, and are made of a softer material so that the strings are cushioned where they bend sharply leaving the grommet holes.

The cushioning strips are most preferably composed of woven or non-woven polyester fibers, and most preferably of needle felt. Also, preferably at least one side of the cushioning strip includes an outer coating of urethane. Alternatively, the cushion strips are made of a foamed rubber material such as urethane foam, which is covered on one side by a solid urethane coating.

In drop tests, racquets utilizing the invention showed a drastic decrease in susceptibility to damage from impact. Moreover, the invention has the additional beneficial effect of reducing the tendency of a hard bumper strip to buzz or rattle.

For a better understanding of the invention, reference is made to the following detailed description of the preferred embodiments, taken in conjunction with the drawings accompanying the application.

DETAILED DESCRIPTION OF A PREFERRED EMBODIMENT

Figure 1:
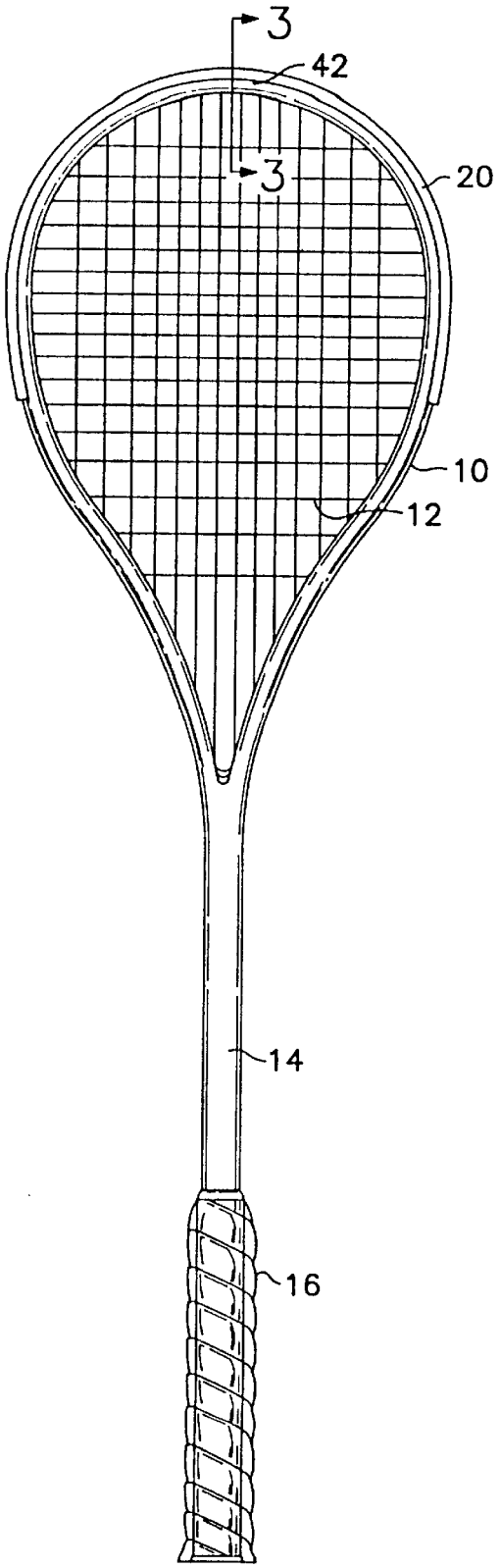
FIGS. 1 and 2 are front and side views, respectively, of a squash racquet containing a bumper strip assembly according to the invention.
Figure 2:
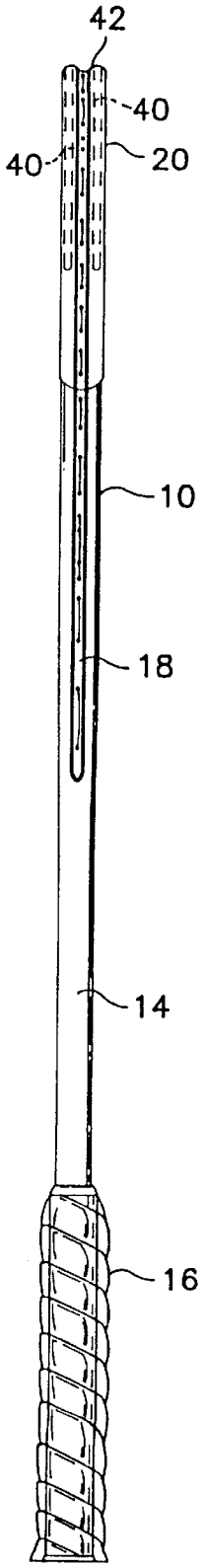

FIGS. 1 and 2 illustrate a squash racquet, such as those marketed by Prince Sports Group, Inc. under the trademark Extender, which lack the conventional throat bridge. The racquet includes a frame defining a head portion 10 containing stringing 12, a shaft 14, and a handle 16. Each side of the racquet includes a conventional grommet strip 18, which is located in a string groove formed on the outside of the frame head 10 in a conventional manner. Moreover, a bumper strip assembly 20 extends along the outside of the frame in the outer region of the head 10.

Figure 3:
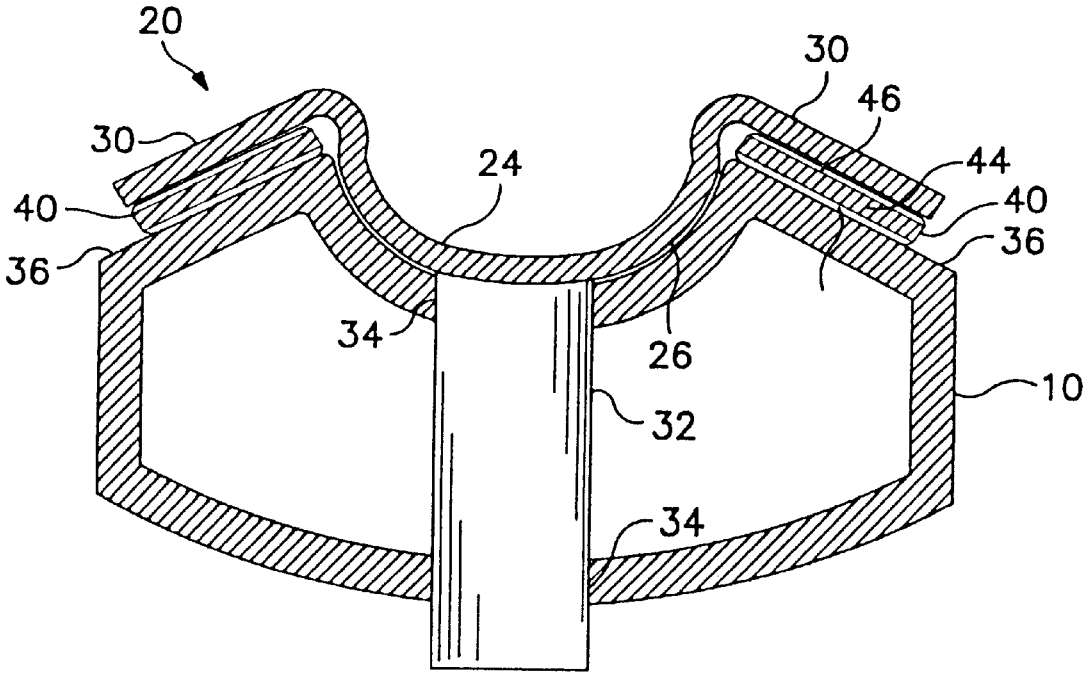
FIG. 3 is a cross-sectional view of the bumper strip assembly and racquet frame, taken through lines 3—3 of FIG. 1.

Referring to FIG. 3, the bumper strip assembly 20 may include a conventional bumper strip 22, which includes a central strip portion 24, lying in the stringing groove 26 formed in the frame head 10, and a pair of flanges 30 that extend laterally to either side of the central strip portion 24. Grommet pegs 32 extend from the central strip portion 24, perpendicular thereto, through string holes 34 drilled through the frame head 10 in the stringing groove 26. In the example of FIGS. 1–3, the bumper strip 22 is molded as a single unit, and preferably is formed of a relatively hard plastic such as nylon having a hardness of about 80 Shore D durometer. Insofar as the bumper strip 22 in this embodiment is conventional, details of the strip need not be described further.

As shown in FIG. 3, the racquet head portion 10 includes surfaces 36 to either side of the stringing groove 26. These surfaces 36 are normally covered over, in substantial part, by the laterally projecting flanges 30 of the bumper strip 22 in order to protect the surfaces 36 from the danger of impact with the wall or floor of the court. In accordance with the present invention, a cushioning strip 40 is sandwiched between the flanges 30 of the bumper strip 20 and the frame head outer surfaces 36. The cushioning strips 40 are provided at least in the region of the outer tip 42 of the head 10, as shown in FIGS. 1–2, but may if desired extend along substantially the entire length of the flanges 30. The cushioning strips 40 are preferably secured either to the flanges 30 of the bumper strip 20, or to the frame surfaces 36, by adhesive or double face tape.

The cushioning material of the strips 40 are preferably made of felt material, and most preferably a woven or non-woven fibrous, polymeric material. In one example, the cushioning strip 40 is formed of a polyester fiber felt 44, having a urethane outer coating 46 on at least one side, or alternatively on both sides. Polyester fiber felts 44 having a urethane outer coating 46 on one side are presently sold as grips for tennis racquets, for example by Prince Sports Group, Inc. under the name "Cushion Grip" with extra tack, and are known as polyurethane hi-soft grip material. Such materials, in which the urethane outer coating is applied to the felt, are presently manufactured in sheets, which are then cut into narrow strips of grips material. Such materials are the preferred embodiment of a cushioning strip for use in the present invention as well.

Alternatively, the cushion strips 40 are made of a polymer cellular foam such as urethane foam, which has a low density and excellent compression set resistance (memory), and which provides good cushioning. As in the case of the felt material, the urethane foam strips 40 have a density of 0.8 g/cc or less, preferably in the range of 0.35–0.60 g/cc, and a hardness of 60 Shore A durometer or less, preferably in the range of 50–60 Shore A durometer. As used in the specification and claims, the term "cushion polymer foam" refers to such urethane foam or other polymer foam materials having comparable properties. Urethane foam materials which are suitable for the invention are currently sold as racquet grips, for example by Prince Sports Group, Inc. under the name "SoftZorb" Vibration Dampening Replacement Grip, which is a urethane cellular foam with a urethane surface coating.

Another suitable material is Poron urethane sheet material, which has a high compression set capability. Preferably, 1/16" thick sheet material is used, such as #4701-12-30061 w/256 PSA. Such material are marketed by Stockwell Rubber Company, Philadelphia, Pa., U.S.A.

In the squash racquet example of FIGS. 1–3, each cushioning strip 40 has a length "1" of 30.5 cm, which is somewhat less than the length of a standard squash racquet bumper strip 30, but which provides cushioning to the most vulnerable outlying regions of the frame. If desired, the strips can extend along the entire bumper strip length, or have a shorter length than 30.5 cm if it desired to cushion less of the outer tip region. The portion of the outer frame surface for which it is desirable to provide cushioning may vary, for example, depending upon the curvature and shape of the outer tip region of the frame.

Figure 4:
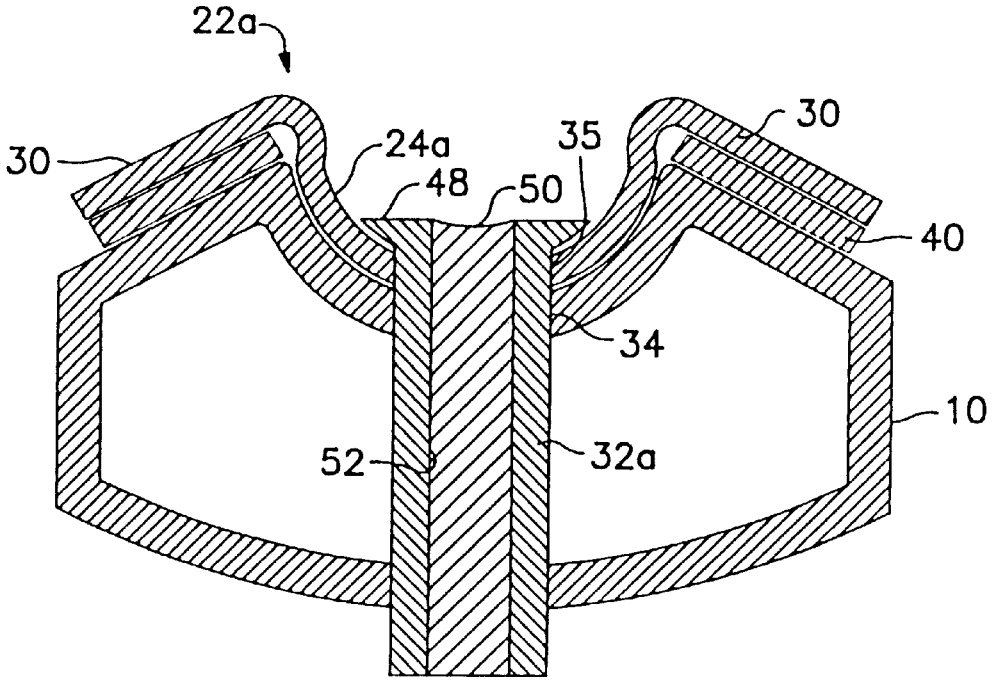
FIGS. 4 and 5 are a cross-sectional views, similar to FIG. 3, of alternative embodiments of the invention.

In the example, each cushioning strip 40 has a width "w" of 0.6 cm, and a thickness "t" of 0.17 cm. The felt material is a non-woven polyester needle felt, and has an average density of approximately 0.45 g/cc (including urethane coating). Thus, the total weight of the two strips is as follows:

weight per strip=total volume of 2 strips×density total volume=2×(30.5 cm×0.6 cm×0.17 cm)=6.22 cc total weight=6.22 cc×0.45 g/cc=2.8 g FIG. 4 shows an alternative embodiment in which the bumper strip 22*a* is separate from the grommet pegs 32*a*.

The center strip 24*a* includes holes 35 that align with the racquet string holes 34, and which receive the grommet pegs 32*a*. The grommet pegs 32*a* are connected by a grommet strip 48, which includes an annular flange that seats against the upper surface of the center strip 24*a*. When the racquet is strung, the strings extend through the grommet pegs 32*a* and along the outside of the frame over the grommet strip 48.

In the embodiment of FIG. 4, preferably the center strip 24*a* and flanges 30 are formed of hard nylon, however the grommet strip and pegs 48, 32*a* are formed of a softer plastic, for example a thermoplastic having a hardness less than 90 Shore A. Accordingly, the upper edge 50 of the grommet hole 52, where the string makes a sharp bend to extend along the grommet strip 48 and center strip 24*a*, is thus cushioned by the softer grommet material.

Figure 5:
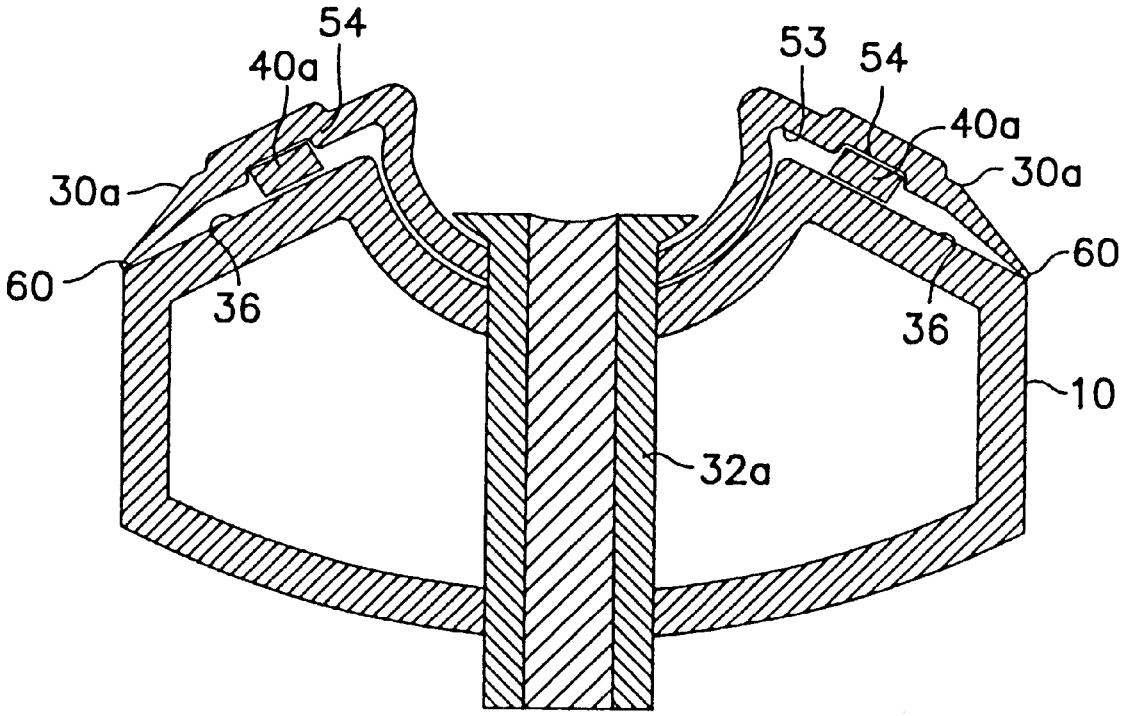

FIG. 5 shows an alternative embodiment where the underside 54 of each flange 30*a* includes a groove 54, that receives the cushioning strip 40*a* to secure it in place. As shown, the cushioning strips 40*a* extend far enough out of the grooves 54 to prevent the flanges 30*a* from having any substantial contact with the frame surfaces 36. However, if desired the outer edges 60 of the flanges 30*a* may turn downwardly to rest against the outer surfaces 36 of the frame head 10, thus hiding the cushioning strips 40*a*.

Figure 6:
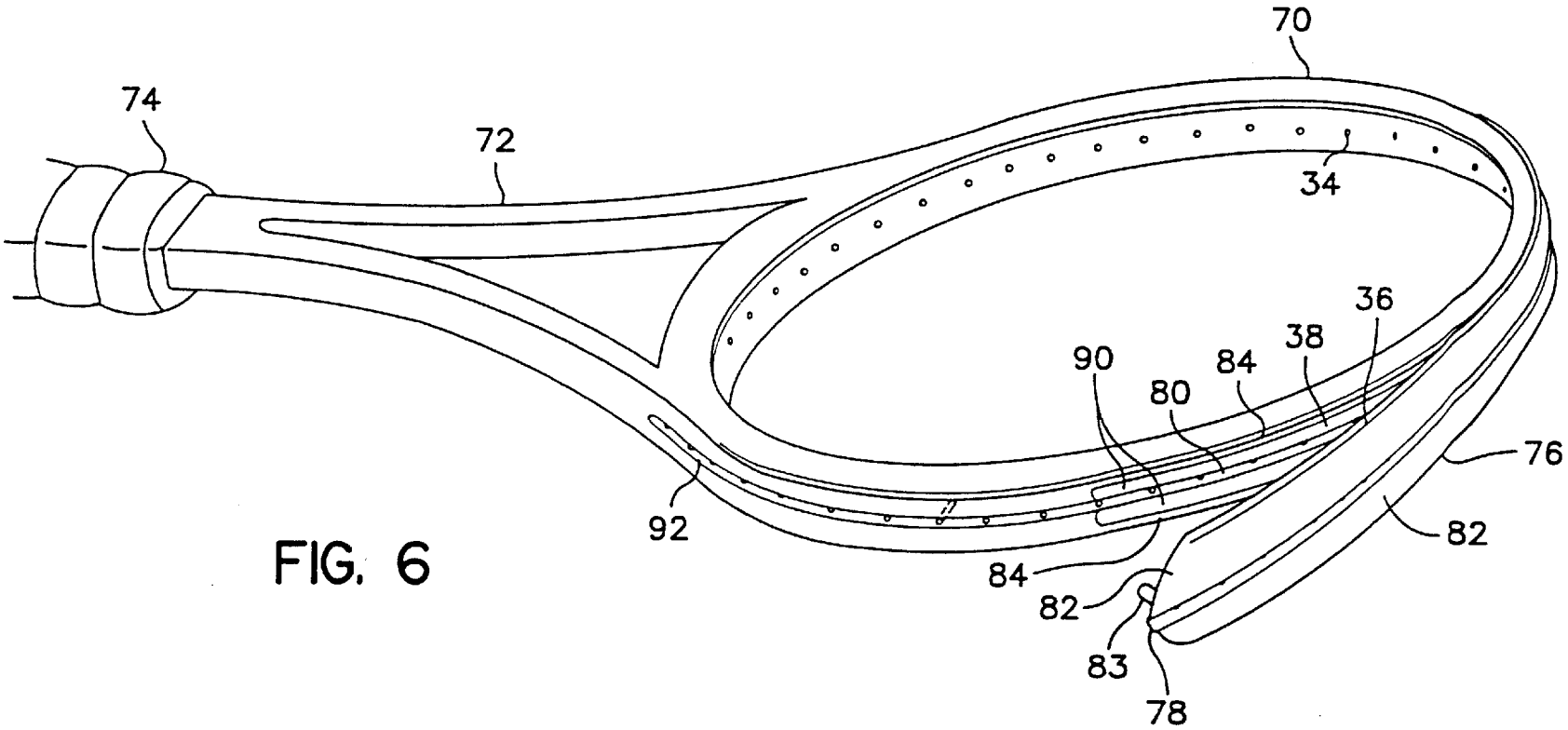
FIG. 6 is a perspective view of a tennis racquet showing a further embodiment of the invention.
Figure 7:
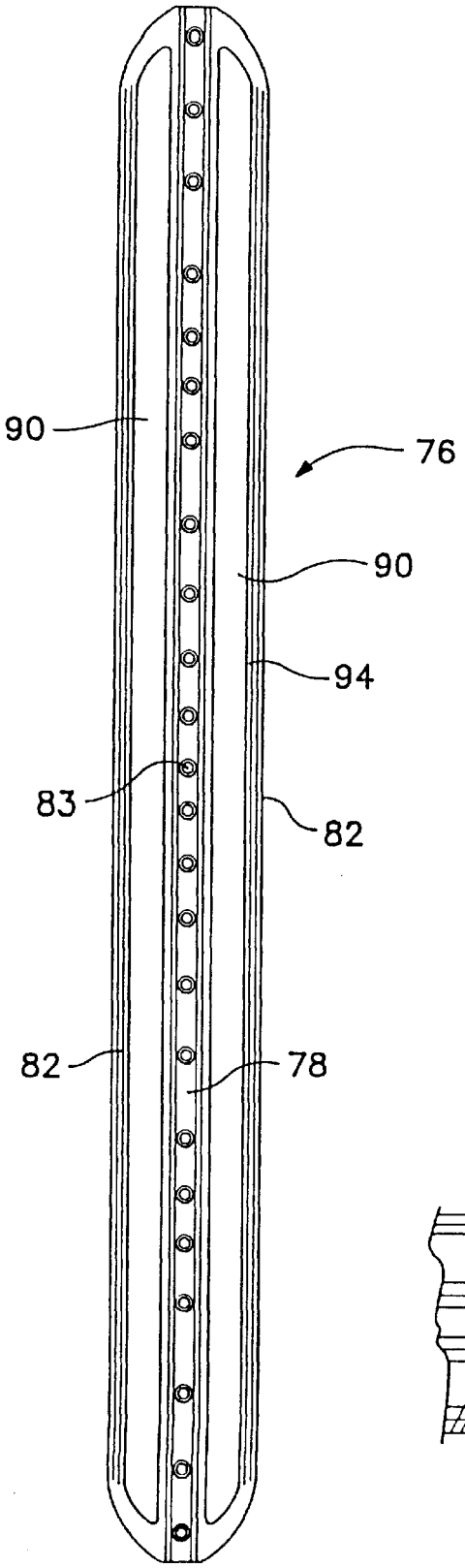
FIG. 7 is a bottom view of the bumper strip assembly of FIG. 6, shown in a flat condition.
Figure 8:
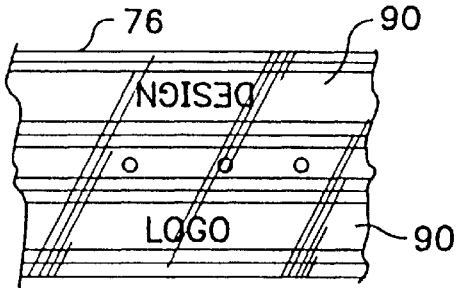
FIG. 8 is a top view of a section of the bumper strip assembly of FIG. 7.

FIGS. 6–9 illustrate two embodiments of a bumper strip assembly for a tennis racquet having a head portion 70, a throat region 72, and a handle 74. In the embodiment of FIGS. 6–8, the bumper strip 76 is a conventional tennis racquet bumper strip including a center strip 78 received in the stringing groove 80 of the frame head 70, and a pair of flanges 82 that extend laterally to either side to cover the outer surfaces 84 of the racquet head 10 that lie to either side of the stringing groove 80. The bumper strip also includes a plurality of grommet pegs 83.

A cushioning strip 90 is provided under each flange 82, and is sandwiched between the flange 82 and frame head 10 surfaces 84 to prevent substantial contact between the bumper strip flanges 82 and frame surfaces 84. FIG. 6 also shows one of the conventional grommet strips 92 that lie in the stringing groove 80.

In FIG. 6, the cushioning strips 90 are shown positioned over the outer frame surfaces 84. Preferably, the cushioning strips 90 are adhered either to the frame surfaces 84, as shown in FIG. 6, or to the underside 94 of the flanges 82, as shown in FIG. 7.

In the embodiment of FIGS. 6–8, the bumper strip 76 may be formed of a clear plastic, and the upper surface of the cushioning strip, which is formed by the urethane outer coating, can be given a decorative design or logo as shown in FIG. 8. Alternatively or at the same time, the urethane outer coating can be given a decorative color.

Figure 9:
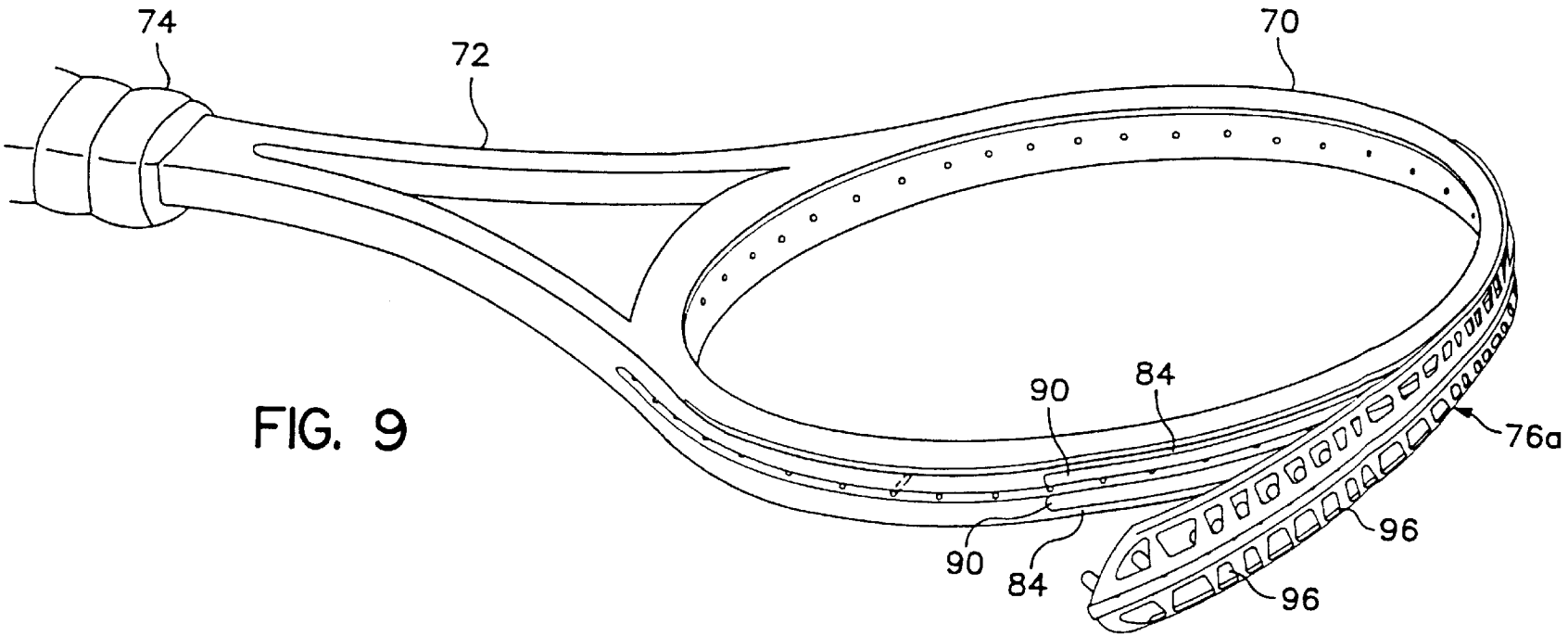
FIG. 9 is a perspective view of a tennis racquet showing another embodiment of the invention.

The embodiment of FIG. 9 is the same as FIGS. 6–8, except that the bumper strip 76*a* has a series of cutouts 96, as disclosed in commonly owned U.S. Pat. No. 5,029,859. As disclosed in the '859 patent, the holes 96 have the desirable effect of reducing the weight in the tip. When used with the present invention, the holes 96 partially expose the cushioning strips 90, and for this purpose the upper surfaces of the strips may be imprinted with a decorative design or logo that aligns with the holes 96.

As shown in FIG. 7 (as well as FIGS. 6 and 9), each cushioning strip 90 has a length which is substantially coextensive longitudinally with its respective flange 82. In other words, the strips 90 extend in the axial direction essentially the entire distance along the bumper strip 76. As shown in FIG. 7, the cushioning strips also have a width so as to underlie most of the undersurface of the flanges and thereby space most of the undersides of the flanges (e.g., except along their outlying edges) away from the frame surface. Alternatively, as shown in FIG. 5, the cushioning strips have sufficient height to space most of the flange undersurface from direct contact with the frame. In either case, any impact forces transmitted between the flanges and the frame at least largely pass through one or both of the cushioning strips.

Squash racquets having a cushioned bumper according to the embodiment of FIGS. 1–3 of the invention were subjected to head drop tests. The test racquets included a pair of 1.7 mm thick strips of urethane-coated felt, weighing a total of approximately 3 grams, between the respective flanges of the bumper strip and the graphite frame. The racquets having the cushioned bumper were tested against the same racquets with a conventional bumper strip. In order that the test racquets all have the same weight, 3 additional grams of carbon fiber-reinforced epoxy were added below the bumper strip to the racquets lacking the cushioning strips.

All the racquets were strung at 22 lbs. string tension, and 400 grams of weight were attached to the butt to simulate impact during play. The racquets were then dropped at increasing heights, beginning at a height of 140 cm. The racquets were dropped in a vertical position, so as to land on the bumper strip, at 10 drops per height, until the frames broke or cracked.

On average, racquets according to the invention survived 70% more drops before failure than the same racquets without the felt cushioned bumper, indicating a 70% increase in durability. Thus, the invention demonstrated a drastic improvement in protecting the frame from the cracking and breakage that can occur during normal playing conditions.

Racquets containing cushioning strips of urethane foam were tested in similar drop tests and found also to increase substantially the durability of the racquet against impact damage.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

I claim:

1. A bumper strip assembly for use on a sports racquet having a plurality of string holes and a head having an outer region with outwardly facing surfaces lying to either side of the string holes, comprising:

a bumper strip portion including a center strip portion, having a plurality of holes therethrough corresponding to the string holes of a sports racquet, and a pair of laterally extending flanges, made of a relatively hard, durable material, and having undersides, wherein said flanges have outer longitudinal edges spaced from said center portion a distance so that said flanges will extend over at least substantially all of the outwardly facing surfaces in a tip region of a sports racquet frame; and a pair of cushioning strips, each comprising a lightweight, polymeric fibrous material, having a density less than 0.8 g/cc, disposed against the undersides of the flanges such that, when the assembly is mounted on a sports racquet frame, the cushioning strips are sandwiched between the frame surface and the undersides of the flanges, wherein said cushioning strips have a length and a width which are at least substantially co-extensive with said flanges, and wherein said cushioning strips act to space at least most of said undersides of said flanges from the frame surface, whereby any impact forces transmitted between said flanges and the frame at least largely pass through one or both of said cushioning strips.

2. An assembly as recited in claim 1, wherein the cushioning material has a density in the range of 0.35–0.60 g/cc.

3. An assembly as recited in claim 2, wherein the cushioning material has a hardness of 60 Shore A durometer or less.

4. An assembly as recited in claim 3, wherein the cushioning material has a hardness in the range of 50–60 Shore A durometer.

5. An assembly as recited in claim 1, wherein the underside of each flange includes a groove for receiving a respective cushioning strip.

6. An assembly as recited in claim 1, further comprising a plurality of grommet pegs extending from the center strip portion substantially perpendicular thereto.

7. An assembly as recited in claim 6, wherein the bumper strip portion is formed of a relatively hard plastic and the grommet pegs are formed of a softer material.

8. An assembly as recited in claim 6, wherein the bumper strip portion and grommet pegs are molded as a single unit.

9. An assembly as recited in claim 1, wherein the at least one cushioning strip is composed of woven or non-woven fibers.

10. An assembly as recited in claim 9, wherein the at least one cushioning strip is composed of needle felt of polyester fibers.

11. An assembly as recited in claim 9, wherein said fibers are composed of polyester.

12. An assembly as recited in claim 11, wherein said cushioning strip includes an outer coating of urethane.

13. An assembly according to claim 12, wherein the cushioning strip has a density of about 0.45 g/cc.

14. An assembly according to claim 13, wherein the cushioning strip has a hardness of about 55 Shore A durometer.

15. An assembly as recited in claim 1, wherein said bumper strip portion is made of a clear plastic, and wherein each cushioning strip includes an upper surface which is visible through said clear plastic and which contains a logo, a decorative design, or a decorative color.

* * * * *